US007385561B2

(12) United States Patent
Krupa

(10) Patent No.: US 7,385,561 B2
(45) Date of Patent: Jun. 10, 2008

(54) MULTIPLE MONOPOLE ANTENNA

(75) Inventor: Steve Krupa, Cambridge (GB)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 11/346,791

(22) Filed: Feb. 3, 2006

(65) Prior Publication Data

US 2006/0181466 A1 Aug. 17, 2006

Related U.S. Application Data

(60) Provisional application No. 60/654,013, filed on Feb. 17, 2005, provisional application No. 60/673,588, filed on Apr. 21, 2005.

(51) Int. Cl.
*H01Q 21/00* (2006.01)

(52) U.S. Cl. ..... 343/728; 343/725; 343/741; 343/743; 343/866

(58) Field of Classification Search ..... 343/866, 343/870, 741, 700 MS, 713, 702, 725, 728, 343/743
See application file for complete search history.

(56) References Cited

U.S. PATENT DOCUMENTS 4,218,685 A 8/1980 Frosch et al.
5,406,295 A 4/1995 Baranski et al.
5,617,102 A 4/1997 Prater
5,764,190 A 6/1998 Murch et al.
5,838,283 A 11/1998 Nakano
6,680,705 B2 1/2004 Tan et al.
6,853,339 B2 2/2005 Sievenpiper et al.
6,888,511 B2 5/2005 Cake
2004/0222922 A1* 11/2004 Kuo et al. ..... 343/700 MS
2006/0071871 A1 4/2006 Tang et al.

OTHER PUBLICATIONS

International Application No. PCT/IL06-00197 Search Report dated Mar. 1, 2007.
U.S. Appl. No. 60/654,013, no date avail.
U.S. Appl. No. 60/673,588, filed Apr. 12, 2005.

* cited by examiner

*Primary Examiner*—Hoang V Nguyen
(74) *Attorney, Agent, or Firm*—Darby & Darby PC

(57) ABSTRACT

The present invention seeks to provide a multiple monopole antenna including a looped conductor having at least two conductive arms extending therefrom and a common feed point located on the looped conductor.

13 Claims, 2 Drawing Sheets

MULTIPLE MONOPOLE ANTENNA

FIELD OF THE INVENTION

The present invention relates to antennas generally.

BACKGROUND OF THE INVENTION

The following publications are believed to represent the current state of the art: U.S. Pat. Nos. 6,853,339; 5,617,102 and 4,218,685.

SUMMARY OF THE INVENTION

The present invention seeks to provide an improved antenna.

There is thus provided a multiple monopole antenna including a looped conductor having at least two conductive arms extending therefrom and a common feed point located on the looped conductor.

In accordance with a preferred embodiment of the present invention the multiple monopoles resonate in at least two cellular communications bands. Preferably, at least two of the at least two arms define end portions which are arranged in mutually spaced, overlapping orientations. Additionally or alternatively, the looped conductor and the at least two conductive arms are formed of a single conductive element In accordance with another preferred embodiment of the present invention the looped conductor generally lies in a first plane which is angled with respect to a second plane in which lie that at least two conductive arms. Preferably, the first plane is angled with respect to the second plane by 90-135 degrees.

In accordance with yet another preferred embodiment of the presents invention at least two of the at least two conductive arms have a common near field. Preferably, the location of the common feed point determines relative impedances of multiple monopoles defined by the at least two conductive arms. Additionally and alternatively, the multiple monopole antenna also includes a feed portion which is galvanically coupled to the common feed point. Preferably, the location is influenced by at least one of the length of the feed portion, curvature of the feed portion and spacing of the feed portion.

There is also provided in accordance with another preferred embodiment of the present invention a multiple monopole antenna including a conductor having at least two conductive arms extending therefrom and a common feed point located on the conductor, wherein at least two of the at least two arms define end portions which are arranged in mutually spaced, generally parallel orientations such that the end portions have a common near field.

In accordance with a preferred embodiment of the present invention, the multiple monopoles resonate in at least two cellular communications bands. Preferably, a location of the common feed point determines relative impedances of multiple monopoles defined by the at least two conductive arms.

In accordance with another preferred embodiment of the present invention the multiple monopole antenna also includes a feed portion which is galvanically coupled to the common feed point. Preferably, the location is influenced by at least one of the length of the feed portion, curvature of the feed portion and spacing of the feed portion.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENT

Figure 1:
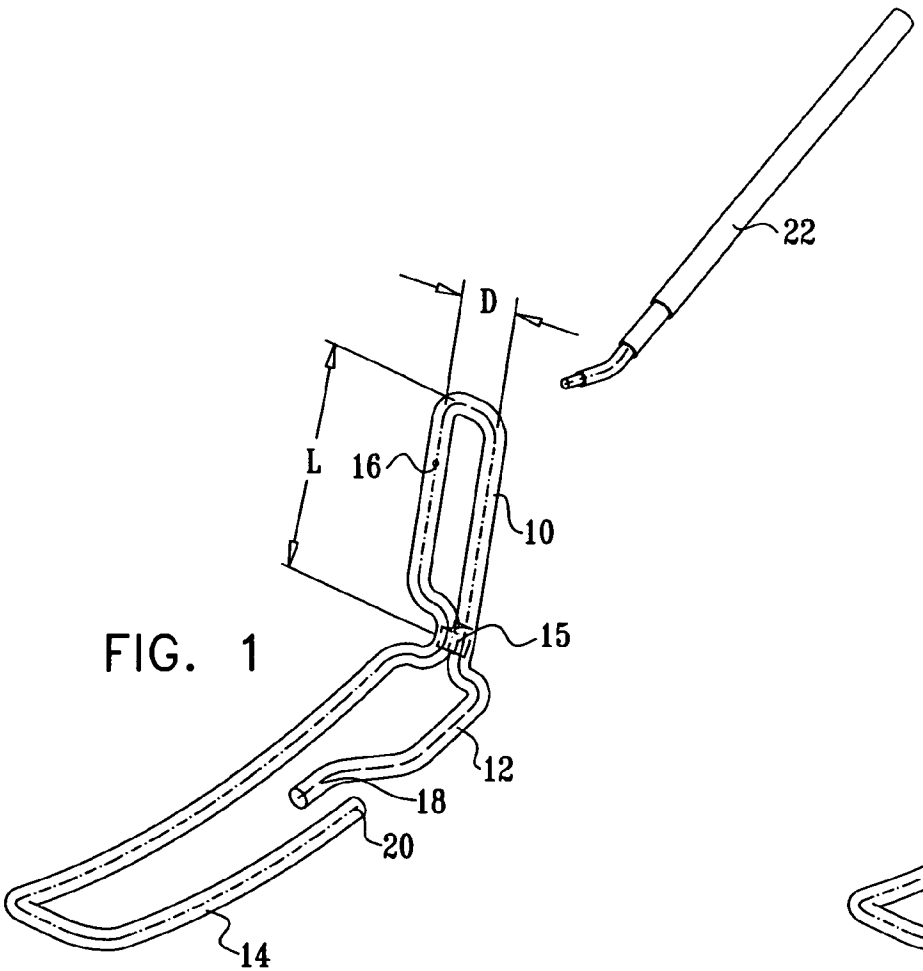
FIG. 1 is a simplified exploded view pictorial illustration of an antenna constructed and operative in accordance with a preferred embodiment of the present invention.

Reference is now made to FIG. 1, which is a simplified exploded view pictorial illustration of an antenna constructed and operative in accordance with a preferred embodiment of the present invention. As seen in FIG. 1, the antenna is a multiple monopole antenna which includes a looped conductor feed portion 10 having two conductive arm portions, respectively designated by reference numerals 12 and 14, extending therefrom. The antenna may advantageously be formed of a single conductive element, which is preferably a straight-gauge wire, having a suitable degree of spring tempering. The looped conductor feed portion 10 is closed into a loop at a loop closing point 15 in any of a plurality of suitable ways, such as, for example, over-bending the looped conductor which results in spring tension that compresses the element in such a way to close the loop. An additional example of a suitable way of closing looped conductor feed portion 10 include using a non-conductive carrier, such as a plastic carrier which maintains the alignment of the different parts of the antenna and soldering the antenna at the loop closing point 15.

Alternately, the looped conductor feed portion 10 may be left open, such that the parallel conductors of the feed form an "hour-glass" shaped gap of suitable distance, in order to further improve the impedance match of the antenna, by varying the size of the "hour-glass" shaped gap which alters the RF coupling in the looped conductor feed portion 10.

A common feed point 16 may be located at a desired location on the looped conductor feed portion 10. The looped conductor feed portion 10 preferably generally lies in a plane which is angled by approximately 90-135 degrees with respect to a plane in which lie the conductive arm portions 12 and 14.

It is a particular feature of the present invention that arms 12 and 14 define end portions, respectively designated by reference numerals 18 and 20, which are arranged in mutually spaced, overlapping orientations and have a common near field.

It is appreciated that more than two conductive arms may be provided. In such a case, as well, the location of the common feed point on the looped conductor determines the relative impedances of multiple monopoles defined by the conductive arms. Preferably the multiple monopoles resonate in at least two different cellular communications bands.

A feedline 22 may be galvanically coupled to any suitably located feed point 16 on the looped conductor feed portion 10. Criteria which may influence the location of the feed point include the length, curvature and spacing of the looped conductor feed portion 10, as well as the relative length, curvature, coupling gap and orientation of arms 12 and 14 with respect to the looped conductor feed portion 10. The length of the looped conductor feed portion 10 is indicated by distance L, and the spacing thereof is indicated by distance D in FIG. 1.

Figure 2:
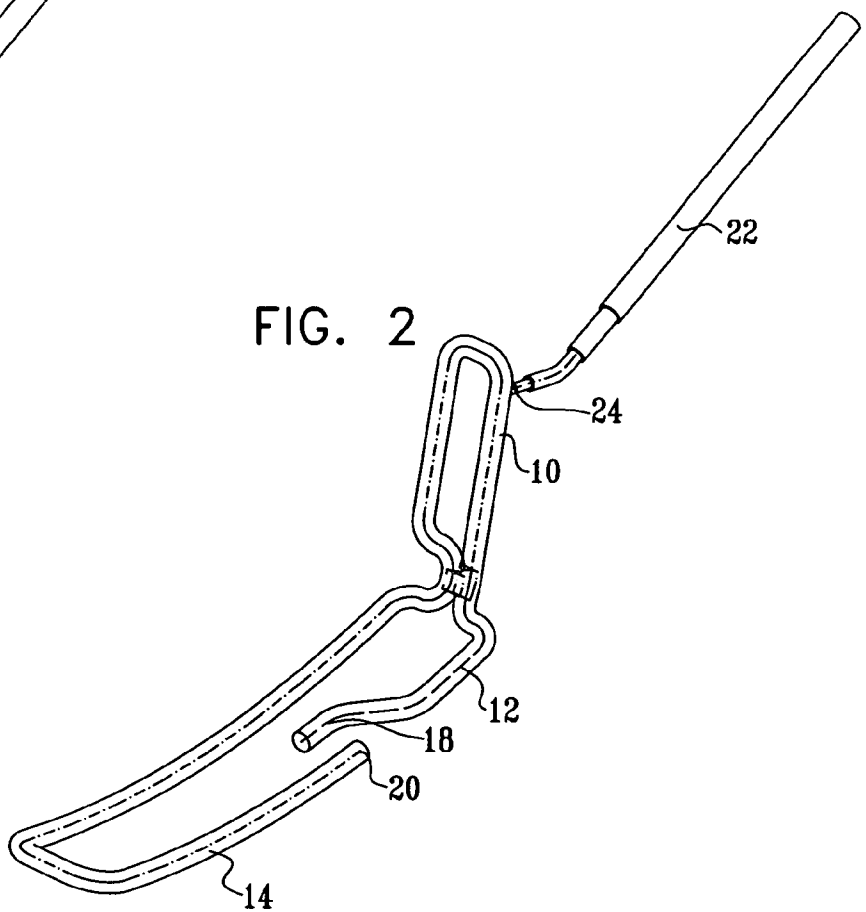
FIG. 2 is a simplified pictorial illustration of the antenna of FIG. 1 in one feed location arrangement.

The antenna and the antenna feedline 22 of FIG. 1 are shown galvanically coupled at a preferred feed point 24 in FIG. 2.

It is appreciated that the antenna of FIGS. 1 and 2 is preferably operated as an unbalanced antenna, which requires a suitably sized GND or counterpoise for optimal bandwidth and radiation efficiency.

Figure 3:
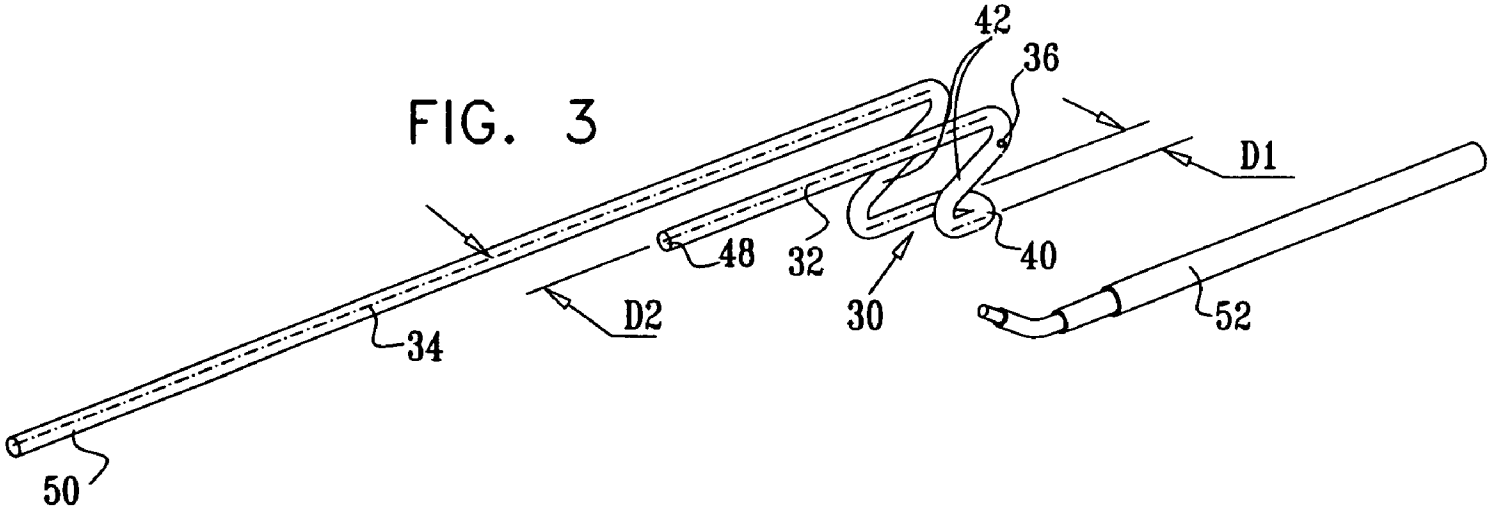
FIG. 3 is a simplified exploded view pictorial illustration of an antenna constructed and operative in accordance with another preferred embodiment of the present invention.

Reference is now made to FIG. 3, which is a simplified exploded view pictorial illustration of an antenna constructed and operative in accordance with a preferred embodiment of the present invention. As seen in FIG. 3, the antenna is a multiple monopole antenna which includes a feed connection portion 30 having two generally parallel spaced conductive arm portions, respectively designated by reference numerals 32 and 34, extending therefrom. A common feed point 36 may be located at a desired location on the feed connection portion 30. The antenna may advantageously be formed of a single conductive element.

The feed connection portion 30 preferably includes a generally planar bent region 40 and a generally planar intermediate region 42 which extends in an inclined direction with respect to the plane of region 40 and interconnects region 40 with conductive arm portions 32 and 34 which preferably lie in a plane parallel to and spaced from the plane of region 40.

It is a particular feature of the present invention that arms 32 and 34 define end portions, respectively designated by reference numerals 48 and 50, which are arranged in mutually spaced orientations which are typically parallel, and have a common near field.

It is appreciated that more than two conductive arms may be provided. In such a case, as well, the location of the common feed point on the looped conductor determines the relative impedances of multiple monopoles defined by the conductive arms. Preferably the multiple monopoles resonate in at least two different cellular communications bands.

A feedline 52 may be galvanically coupled to any suitably located feed point 36 on the feed connection portion 30. Criteria which may influence the location of the feed point include the length, curvature and spacing of the feed connection portion 30, as well as the relative length, curvature, coupling gap, element spacing and orientation of arms 32 and 34 with respect to the feed connection portion 30. The spacing of the feed connection portion 30 is indicated by distance D1, and the element spacing of arms 32 and 34 is indicated by distance D2 in FIG. 3.

Figure 4:
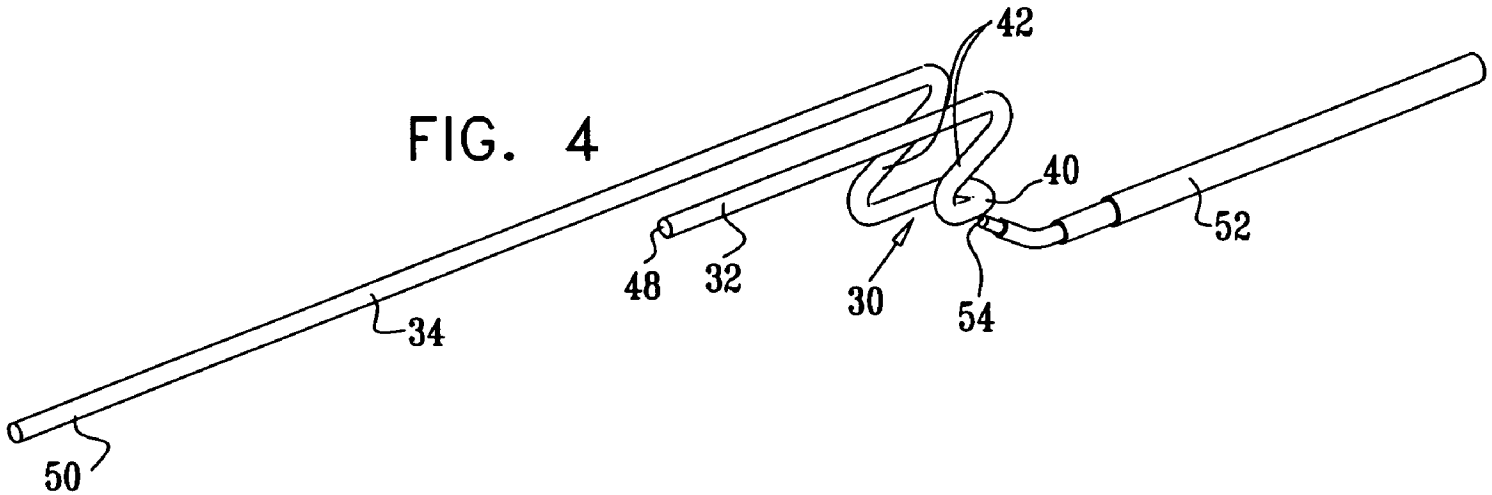
FIG. 4 is a simplified pictorial illustration of the antenna of FIG. 3 in one feed location arrangement.

The antenna and the feedline 52 of FIG. 3 are shown galvanically coupled at a preferred feed point 54 in FIG. 4.

It is appreciated that the antenna of FIGS. 3 and 4 is preferably operated as an unbalanced antenna, which requires a suitably sized GND or counterpoise for optimal bandwidth and radiation efficiency.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. A multiple monopole antenna comprising:

a looped conductor having at least two conductive arms extending therefrom and a common feed point located on said looped conductor, said at least two conductive arms defining at least two monopoles, and at least two of said at least two arms defining end portions which are arranged in mutually spaced, overlapping orientations.

2. A multiple monopole antenna comprising:

a looped conductor having at least two conductive arms extending therefrom and a common feed point located on said looped conductor, said at least two conductive arms defining at least two monopoles, and said looped conductor and said at least two conductive arms being formed of a single conductive element.

3. A multiple monopole antenna comprising:

a looped conductor having at least two conductive arms extending therefrom and a common feed point located on said looped conductor, said at least two conductive arms defining at least two monopoles, and said looped conductor generally lying in a first plane which is angled with respect to a second plane in which lie said at least two conductive arms.

4. A multiple monopole antenna according to claim 3 and wherein said first plane is angled with respect to said second plane by 90-135 degrees.

5. A multiple monopole antenna comprising:

a looped conductor having at least two conductive arms extending therefrom and a common feed point located on said looped conductor, said at least two conductive arms defining at least two monopoles, and at least two of said at least two conductive arms having a common near field.

6. A multiple monopole antenna comprising:

a looped conductor having at least two conductive arms extending therefrom and a common feed point located on said looped conductor, said at least two conductive arms defining at least two monopoles, and a location of said common feed point determining relative impedances of multiple monopoles defined by said at least two conductive arms.

7. A multiple monopole antenna according to claim 6, and also comprising a feed portion which is galvanically coupled to said common feed point.

8. A multiple monopole antenna according to claim 7, and wherein said location is influenced by at least one of the length of said feed portion, curvature of said feed portion and spacing of said feed portion.

9. A multiple monopole antenna comprising a conductor having at least two conductive arms extending therefrom and a common feed point located on said conductor, wherein at least two of said at least two arms define end portions which are arranged in mutually spaced, overlapping orientations such that said end portions have a common near field.

10. A multiple monopole antenna according to claim 9 and wherein said multiple monopoles resonate in at least two cellular communications bands.

11. A multiple monopole antenna according to claim 9, and wherein a location of said common feed point determines relative impedances of multiple monopoles defined by said at least two conductive arms.

12. A multiple monopole antenna according to claim 9, and also comprising a feed portion which is galvanically coupled to said common feed point.

13. A multiple monopole antenna according to claim 12, and wherein said location is influenced by at least one of the length of said feed portion, curvature of said feed portion and spacing of said feed portion.

* * * * *